US006093068A

United States Patent [19]

Turner et al.

[11] Patent Number: 6,093,068

[45] Date of Patent: Jul. 25, 2000

[54] SWIVEL TORQUE TUBE ARRANGEMENT

[75] Inventors: Malcolm E. Turner, Houston; Marshall N. Montgomery, Katy, both of Tex.

[73] Assignee: FMC Corporation, Chicago, Ill.

[21] Appl. No.: 09/334,720

[22] Filed: Jun. 16, 1999

Related U.S. Application Data

[60] Provisional application No. 60/090,071, Jun. 19, 1998.

[51] Int. Cl.[7] ..... B63B 22/02

[52] U.S. Cl. ..... 441/5; 114/230.12

[58] Field of Search ..... 441/3–5; 114/230.12

[56] References Cited

U.S. PATENT DOCUMENTS 5,205,768 4/1993 Pollack ..... 441/5

5,651,708 7/1997 Borseth ..... 441/5

5,755,607 5/1998 Boatman et al. ..... 441/5

5,823,837 10/1998 Boatman et al. ..... 441/5

*Primary Examiner*—Stephen Avila

*Attorney, Agent, or Firm*—Gary L. Bush; Mayor, Day, Caldwell & Keeton, LLP

[57] ABSTRACT

An improved product transfer system is disclosed for a turret moored FPSO. A swivel stack torque tube is provided such that the swivel stack can be recessed below the manifold decks, but still allow swivel torque reactions to be transferred to the ship structure. Recessing of the swivel stack downwardly with respect to the manifold decks reduces the height of the access structure and locates the swivel stack center of gravity closer to the center of gravity of the vessel. This arrangement results in reduced loads to the turret structure, which supports the swivel stack and reduced height and size of the access structure for the swivel stack.

11 Claims, 5 Drawing Sheets

SWIVEL TORQUE TUBE ARRANGEMENT

RELATED APPLICATION

This non-provisional patent application claims priority from provisional application 60/090,071 filed Jun. 19, 1998.

BACKGROUND OF THE INVENTION

1. Field of the Invention

This invention relates generally to mooring systems for floating production, storage and offloading vessels (FPSO). In particular the invention pertains to a swivel arrangement by which risers from subsea wells are rotatively coupled to outlet pipes which run to storage holds on the vessel. Still more particularly, the invention relates to a mechanical arrangement by which outer housings of a swivel stack are coupled together to allow them to rotate with the vessel about a non-rotatable inner housing.

2. Description of the Prior Art

Swivel stacks are known for rotative coupling of risers to outlet pipes on the vessel. A typical swivel stack includes multiple swivels stacked on top of one another with the inner core of each swivel each secured together to form a swivel core stack which is stationarily carried by a non-rotatable turret structure. The turret structure is maintained in a substantially non-rotatable (or "geo-stationary") state by anchor legs which extend to the sea floor. The anchor legs may be connected directly to the turret, as in the case of a permanently moored system, or to a disconnectable spider buoy as in the case of a disconnectable system.

The vessel is rotatatively coupled to the turret by a bearing arrangement and is designed and arranged to weathervane about the turret due to environmental forces on the vessel which create an effective torque on the vessel about the center line of the turret.

Hydrocarbon risers extend from subsea wells or manifolds, run via the interior of the turret, and are terminated on a manifold deck carried by the turret. Prior art arrangements have placed the swivel stack above the manifold deck so that manifold pipes may easily enter the stationary core of the swivel stack and so that a torque arm from the vessel may be easily connected to each outer housing of each swivel in the stack. Such prior art arrangements have created stack heights which extend a great distance above the top of the turret.

IDENTIFICATION OF OBJECTS OF THE INVENTION

A primary object of the invention is to provide a manifold deck and swivel arrangement which reduces the total height of the swivel stack above the top of the turret.

SUMMARY OF THE INVENTION

Manifold decks and a swivel stack are arranged on top of a turret which is rotatively supported on a vessel. Hydrocarbon production risers are provided from the sea bed through the interior of the turret and to the manifold decks. The swivel stack is mounted on the top of the turret with the core of the swivel stack coupled directly to the turret at a location beneath the level of the manifold decks. A torque tube is provided coaxially about the swivel stack with torque arms secured between the torque tube and an outer housing of each swivel in the stack. The torque tube is rotatively supported at its base from the top of the turret and the inner core of the swivel stack. A main torque arm couples the torque tube to the vessel, so that when the vessel weathervanes about the turret, torque is applied to the torque tube, thereby causing each of the torque arms and outer housings of the swivel to rotate about the inner core of the swivel.

Placing the bottom of the swivel stack at a distance beneath the manifold decks results in a lower total height of the swivel stack above the turret. A lower stack height advantageously lowers the center-of-gravity of the swivel stack, reduces torques applied to the turret caused by the swivel stack, and reduces structural requirements of the bearings between the turret and the vessel.

DESCRIPTION OF THE INVENTION

Figure 1:
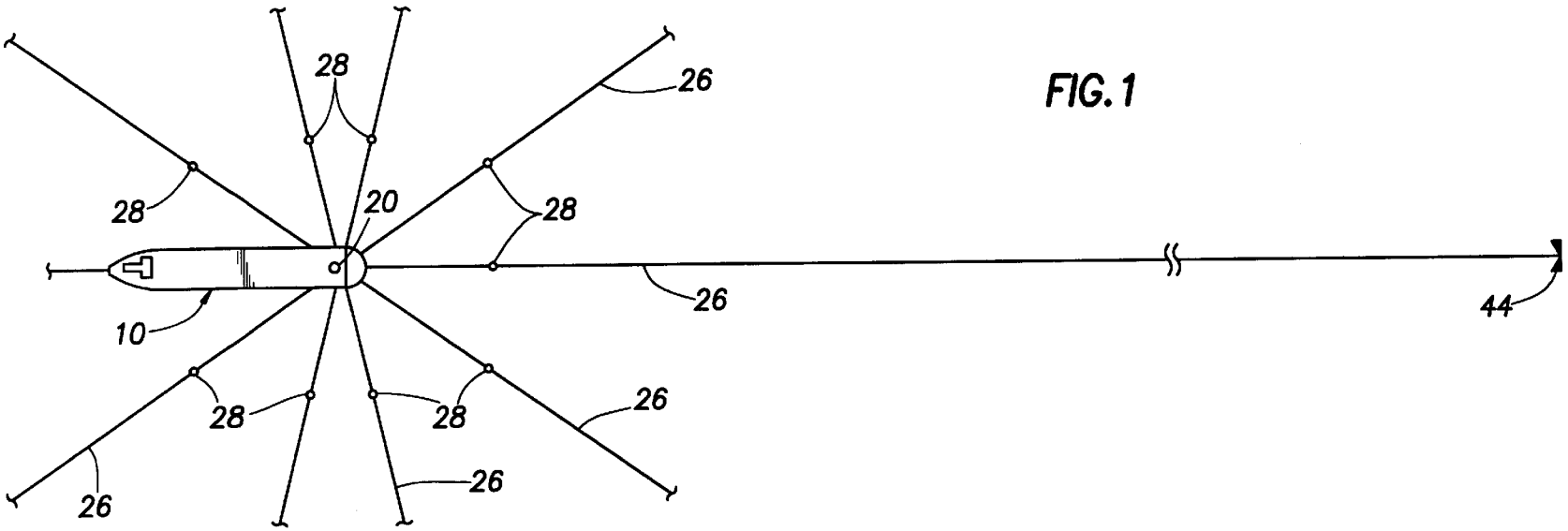
FIG. 1 is a plan view of a turret mooring system of a vessel in the open sea.
Figure 2:
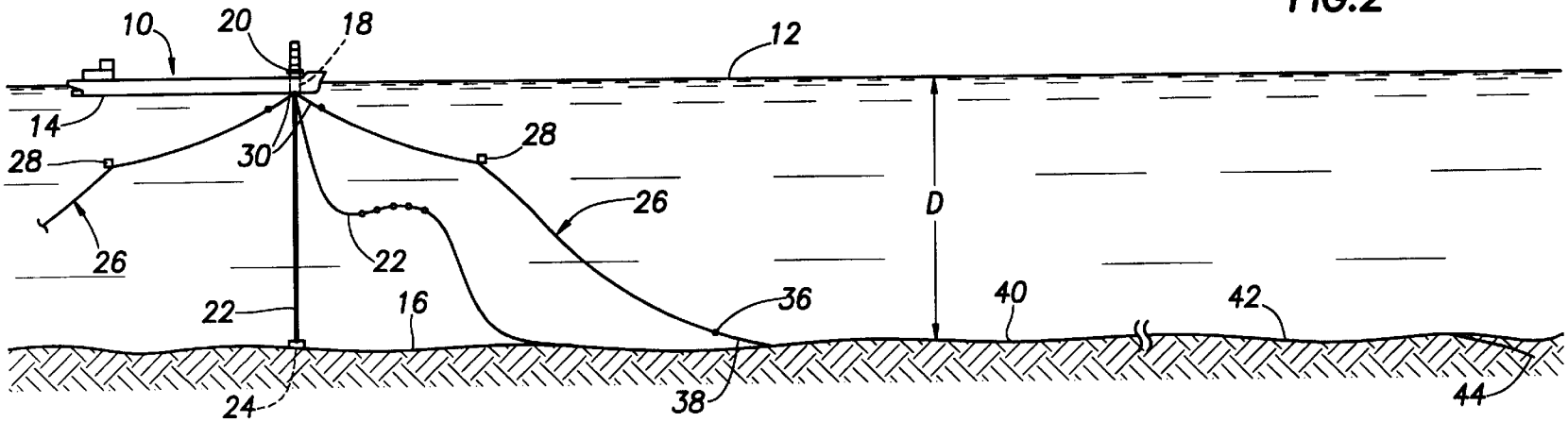
FIG. 2 illustrates a turret moored vessel with hydrocarbon risers connected between the sea bed and the turret to a swivel system on the vessel.

FIGS. 1 and 2 illustrate a mooring system for a vessel. Such mooring system, for the purpose of the invention described below, may alternatively be a permanent mooring system or a disconnectable mooring system. Referring to the drawings, a vessel 10 for the storage, production and offloading of hydrocarbon products is shown as floating on the surface or sea level 12 of a body of water, such as a sea or ocean. Such a vessel is known as a FPSO (Floating Production, Storage and Offloading). Vessel 10 has a keel 14 positioned below the sea surface 12. The sea bed or sea floor is shown at 16. Vessel 10 has moon pool or well at 18 which is positioned centrally of the width of vessel 10. A turret, generally indicated at 20 is mounted on bearings within well 18 for rotation about a vertical axis.

Flexible risers 22 extend from turret 20 downwardly to sea floor 16 and are connected to manifolds or production wells such as illustrated at 24 for the transport of oil or gas to storage vessel 10 for temporary storage. Risers 22 have a sufficient flexible length to permit a predetermined movement of vessel 10 without any damage to risers 22.

A plurality of anchor legs indicated generally at 26 are spaced about turret 20 (at intervals of about thirty-six [36] degrees). A greater number of anchor legs may be provided, or a lesser number of anchor legs, depending upon design considerations. As shown in FIG. 2, a submerged buoy 28 may be placed in each anchor leg 26 (as described in U.S. Pat. No. 5,678,503) or no submerged buoy at all may be provided depending upon design considerations. Each anchor leg 26 is generally identical and includes a plurality of connected chains and wire rope. Each anchor leg 26 is anchored by an anchoring device, such as anchor 44, a substantial distance away from vessel 10.

Figure 3A:
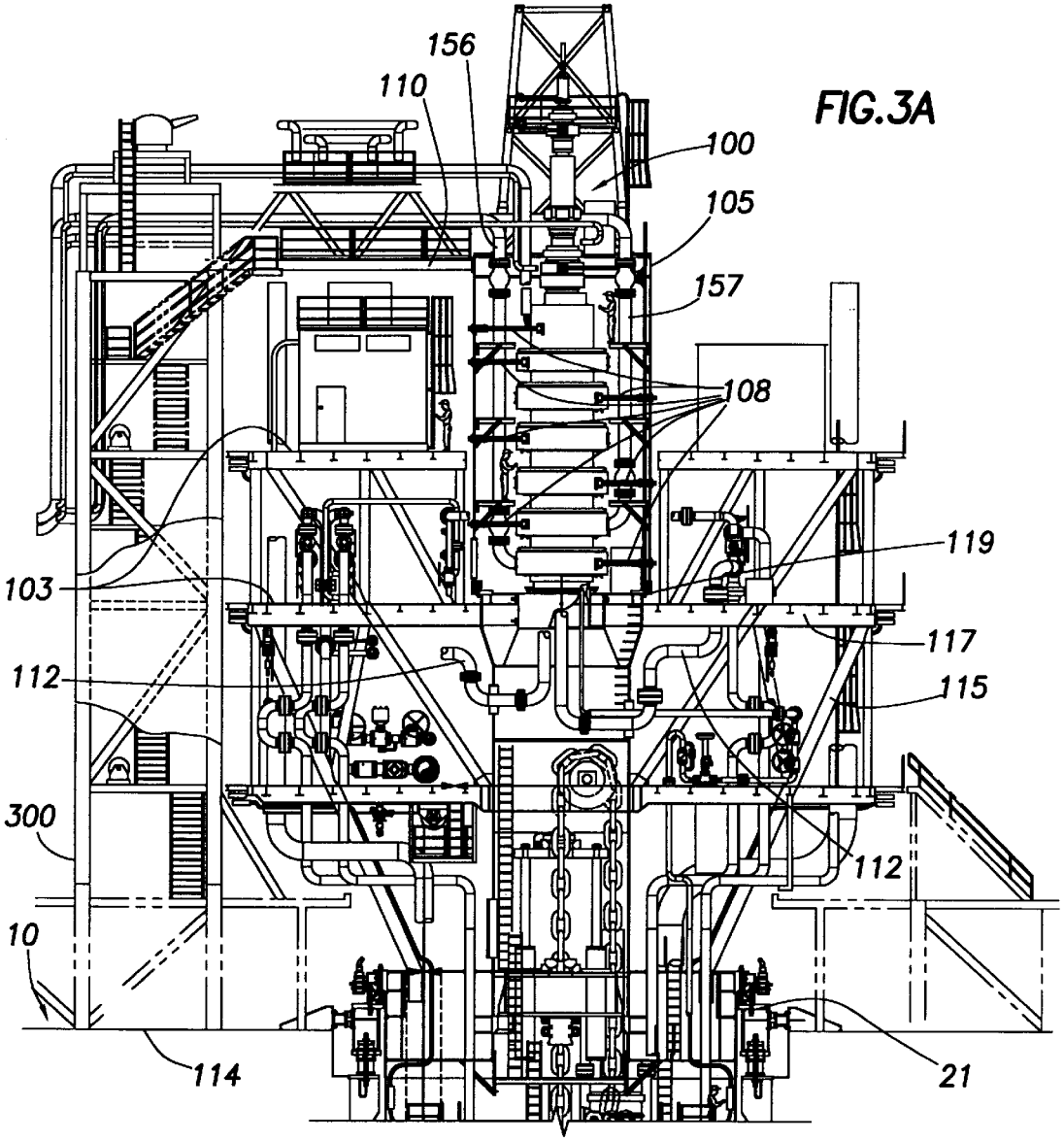
FIGS. 3A and 3B show a first embodiment of the invention which includes a swivel stack, the central core of which is secured to the top of a turret of a mooring system and a torque tube or shaft which connects outer housings of the swivel to a torque arm with the bottom of the swivel stack being below the manifold decks of the mooring system.
Figure 3B:
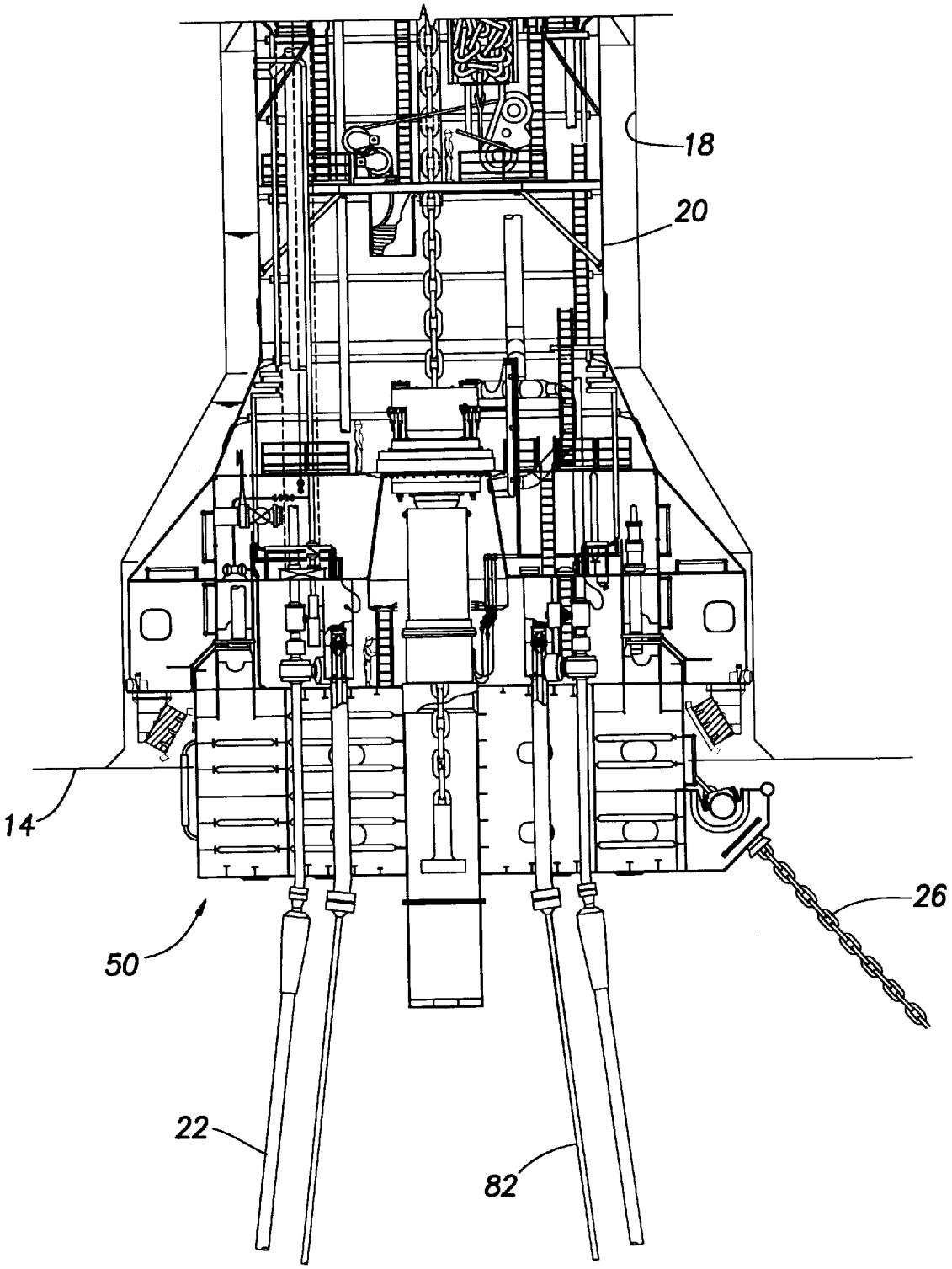

FIGS. 3A and 3B illustrate a first embodiment of the invention of a swivel stack 100 which includes a torque shaft 105 coupled to a torque arm 110 which in turn is secured via structure 300 to the hull of vessel 10. The swivel stack 100 is mounted to the top of turret 20 by means of a frustro-conical shaped structure arrangement 115 to which deck 117 is mounted. The inner core of the swivel stack is secured to the deck 117, while the torque shaft (also called torque tube) 105 is rotatively mounted by means of torque shaft bearing 119 with respect to deck 117. The turret 20 is rotatively mounted with respect to vessel 10 by means of upper bearing assembly 21. Lower radial bearings are also provided. The turret 20 is substantially non-rotative, because it is anchored to the sea floor by means of anchor legs 26. In other words, the turret 20 is substantially "geo-stationary". FIGS. 3A and 3B depict a disconnectable system by which mooring buoy 50 may be rapidly connected or disconnected to the turret 20. Nevertheless, the invention relates to permanently moored turret systems as well as to disconnectable systems as illustrated in FIG. 3. Risers 22 and umbilicals 82 extend upwardly through the turret and run to manifold decks 103.

The entire swivel assembly is provided with a tubular torque shaft 105 to which swivel torque arms 108 are coupled. The torque shaft 105 is secured to vessel torque arm 110. In operation, when the vessel 10 rotates or "weather-vanes" about substantially non-rotative turret 20 by means of bearing 21, the vessel torque arm 110 also rotates (because of the securement to the hull of vessel 10), and causes torque shaft 105 to rotate along with each swivel torque arm 108 and the outer housing of each swivel of swivel stack 100. The inner housing or core of swivel stack 100 is substantially non-rotative, because it is mounted on deck 117 which is secured to the turret 20 by means of structure 115. Torque shaft bearing 119 provides rotative support of the torque shaft 105 with respect to the deck 117 and the inner core of the swivel stack assembly 100.

The risers 22 run to manifold decks 103 for connection to manifolds. The output manifold lines 112 run downwardly from the manifold decks 103 and turn one hundred-eighty degrees for entry into the core of the swivel stack assembly. Each of the several output manifold lines 112 terminates at a respective inlet one of the swivels of the swivel stack 100. Outlet lines, e.g., lines 156, 157, rotate with the vessel 10 as it weathervanes about turret 20. Such lines run via torque arm 110 and structure 300 to storage holds in the vessel.

The provision of torque shaft 105 allows each of the outer housings of swivel stack 105 to be rotated simultaneously by means of a single connection of torque arm 110 to the torque shaft 105. As a result, the bottom of the entire swivel stack assembly 100 can be placed below the manifold decks 103 and therefore positioned closer to main DECK 114 the vessel. As shown in FIG. 3A, the bottom of the swivel stack 100 is placed at the same level as lower manifold deck 103, but below the upper manifold deck 103. The bottom of the swivel stack 100 is positioned below the outlets 112 from the manifolds on both the upper and lower manifold decks 103. This results in a lower center of gravity of the swivel stack 100 and the structures (such as conical structure 115) required to support it on top of the turret 20. Such lower center of gravity reduces torques which are applied to the upper bearing assembly 21 due to the swivel stack assembly. In a nut shell, providing a torque shaft 105, and thereby lowering the swivel stack 100 with respect to the manifold decks, lowers the load carrying specifications required of the upper bearing assembly 21 and provides a more compact, more economical, more efficient swivel stack/turret mooring system for a FPSO.

Figure 4A:
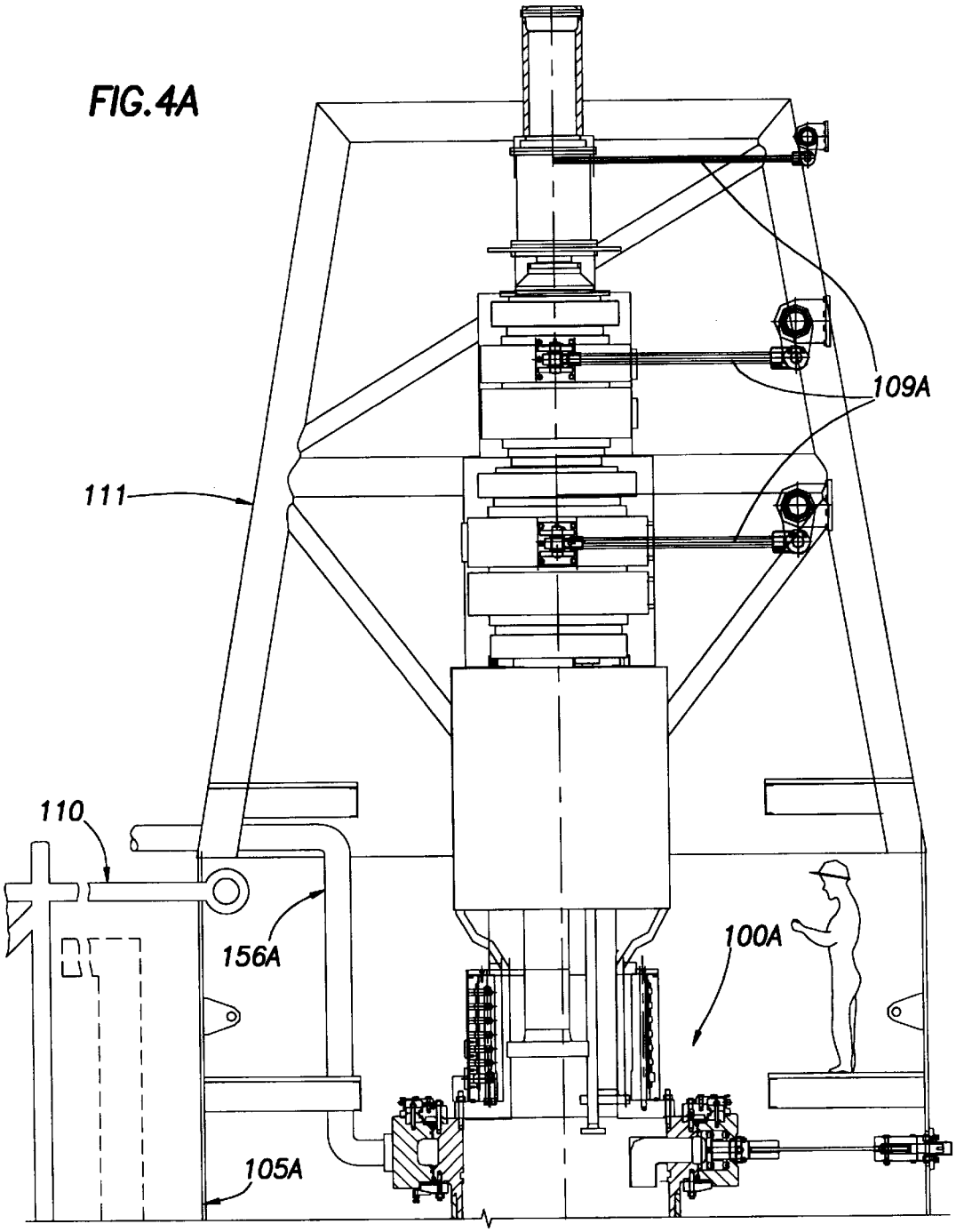
FIGS. 4A and 4B illustrate an alternative embodiment of the swivel stack arrangement of FIGS. 3A and 3B where the bottom of the central core of the swivel stack is connected substantially at the top of the turret tube of the mooring system.
Figure 4B:
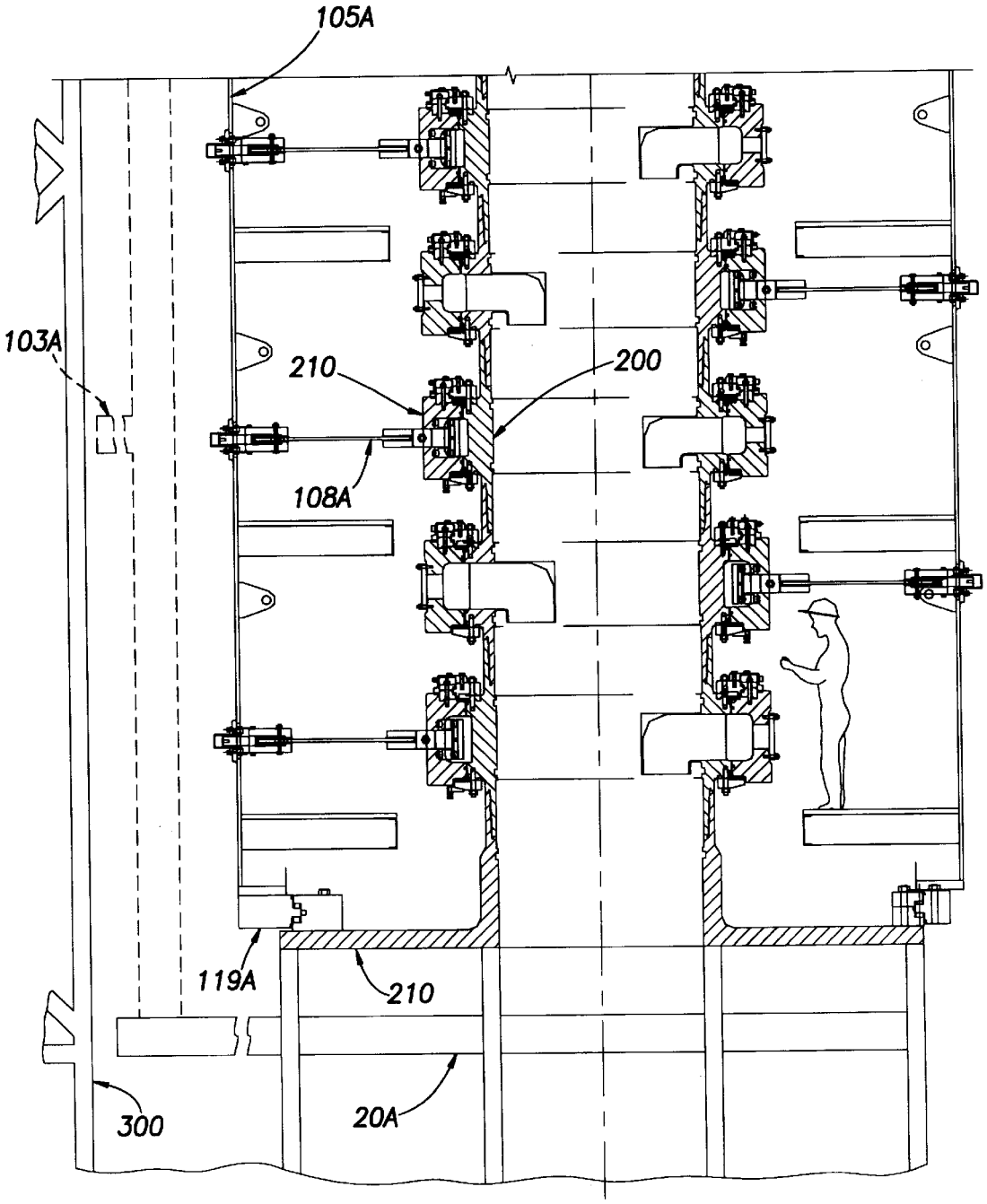

FIGS. 4A and 4B show an alternative embodiment of the arrangement of FIGS. 3A and 3B, where more detail of the preferred swivel stack arrangement is illustrated, and the swivel stack 100A is lowered even further than in the arrangement of FIGS. 3A and 3B by connecting the base 210 of the swivel stack 100A adjacent the top of the turret 20A, rather than providing the frustro-conical shaped structural arrangement 115 of FIGS. 3A and 3B. FIGS. 4A and 4B show the manifold decks 103A to which risers run to manifolds and outlet lines (not shown) run downwardly and upwardly into the interior of core of stack 100A. Torque arms 108A are secured between torque tube 105A and outer housings 210. A bearing 119A provides rotative support of torque tube 105A on base 210.

A torque tube extension structure 111, formed of pipe, extends upwardly from torque tube 105A. Torque arms 109A are provided which extend from torque tube extension structure 111 to the outer housings of additional swivels for electrical and hydraulic paths from the weathervaning vessel to the substantially non-rotating turret and umbilicals 82 (see FIGS. 3A and 3B) to seabed wells and other facilities.

What is claimed is:

1. A product transfer system for a vessel (10) floating on the sea comprising:

a turret (20) rotatably supported with respect to said vessel, an anchoring system (50, 26) connected between the turret (20) and a seabed (42) by which the turret is maintained substantially stationarily with respect to said seabed, a manifold deck (103) carried by a support structure (115, 117) which is fixed to a top end of said turret (20), hydrocarbon transport lines (22) running from a source of hydrocarbon product on said seabed to manifolds on said manifold deck (103), each of said manifolds having a manifold outlet line (112), a plurality of product swivels forming a product swivel stack (100) carried by said support structure (115, 117) where each product swivel of said product swivel stack includes a stationary housing including an inlet connected to a manifold outlet (112) and a rotatable housing including a swivel outlet (156, 157) in fluid communication with a transport pipe which runs to a storage hold of the vessel, a torque tube (105) mounted for rotation about said turret (20) and coaxially placed about said product swivel stack (100) with said stationary housings of said product swivels of said product swivel stack (100) fixed together to form a swivel core and with said stationary housings being fixedly mounted with respect to said support structure (115, 117), a swivel torque arm (108) connected between said torque tube (105) and each one of said rotatable housings, and a main torque arm (110) coupled between said torque tube (105) and said vessel (10), wherein at least one of said manifold outlet lines (112) runs downwardly from said manifold deck and turns upwardly for entry into a bottom end of said swivel core for connection to one of said product swivels of said product swivel stack (100).

2. The product transfer system of claim 1, wherein;

said support structure includes a frustro-conically shaped frame (115) having a bottom end mounted to said top end of said turret (20), and a mounting platform (117) secured to a top end of said conical frame, and said torque tube is supported for rotation by a bearing assembly (119) mounted on said mounting platform (117).

3. The product transfer system of claim 1, wherein;

said support structure is a base member (210) secured to said swivel core of said swivel stack (100A) and said base member (210) is carried by said top end of said turret, and said torque tube (105A) is supported for rotation by a bearing assembly (119A) mounted on said base member (210).

4. The product transfer system of claim 1, wherein;

said product swivel stack includes electrical and hydraulic swivels with inner housings of said electrical and hydraulic swivels secured to said swivel core of said product swivel stack, and with outer housings of said electrical and hydraulic swivels coupled to said torque tube.

5. The product transfer system of claim 1 wherein, said support structure (115, 117) includes a deck (117), which simultaneously serves as a manifold deck (103).

6. The product transfer system of claimed 1 wherein, said swivel core of said product swivel stack (100) has a bottom entry for said manifold outlet lines (112) which is below said manifold deck (103).

7. A product transfer system for a vessel (10) floating on the sea comprising:

a turret (20) rotatably supported with respect to said vessel, an anchoring system (50, 26) connected between the turret (20) and a seabed (42) by which the turret is maintained substantially stationarily with respect to said seabed, a plurality of product swivels forming a product swivel stack (100) where each product swivel of said product swivel stack (100) includes a stationary housing including an inlet and a rotatable housing including a swivel outlet which is in fluid communication with a transport pipe which runs to a storage hold of the vessel, with said stationary housings of said product swivels of said product swivel stack (100) fixed together to form a swivel core and with said stationary housings being fixedly mounted and carried by said top end of said turret (20), hydrocarbon transport lines running from a source of hydrocarbon product on said seabed to respective inlets of a said product swivel of said product swivel stack, a torque tube (105) mounted for rotation about said turret (20) and coaxially placed about said product swivel stack (100), a swivel torque arm (108) connected between said torque tube (105) and each one of said rotatable housings, and a main torque arm (110) coupled between said torque tube (105) and said vessel (10).

8. The product transport system of claim 7 wherein, said transport lines from said seabed run to a manifold deck to manifolds which have outlets which are above or at the same height as a bottom end of said swivel core.

9. The product transport system of claim 8 wherein, at least one of said manifold outlet lines (112) runs downwardly from said manifold deck and turns upwardly for entering into a bottom end of said swivel core and to said respective inlets of said product swivels.

10. The product transfer system of claim 7 wherein, said stationary housings are carried by a support structure that includes a frame having a bottom end mounted to said top end of said turret (20) and a mounting deck secured to a top end of said frame, and said torque tube is supported for rotation by a bearing assembly mounted on said support structure.

11. The product transfer system of claim 10 wherein, said support structure is a base member (210) secured to said swivel core of said swivel stack (100A) and said base member (210) is carried by said top end of said turret, and said torque tube (105A) is supported for rotation by a bearing assembly (119A) mounted on said base member (210).

* * * * *